United States Patent [19]

Peterson et al.

[11] 4,241,961

[45] Dec. 30, 1980

[54] TWO LEVEL SEWING MACHINE CABINET

[75] Inventors: Wesley R. Peterson, Boundbrook; Douglas C. Lang, Holmdel, both of N.J.

[73] Assignee: The Singer Company, Stamford, Conn.

[21] Appl. No.: 58,231

[22] Filed: Jul. 16, 1979

[51] Int. Cl.[3] ..... A47B 51/00; D05B 75/00

[52] U.S. Cl. ..... 312/22; 312/24; 312/27; 312/30; 112/217.1

[58] Field of Search ..... 312/21, 22, 23, 24, 312/25, 26, 27, 28, 29, 30, 208; 112/217.1, 258, 260

[56] References Cited

U.S. PATENT DOCUMENTS

| | | | |
|---|---|---|---|
| Re. 28,835 | 6/1976 | Roberts et al. | 312/22 |
| 1,388,243 | 8/1921 | Dragner et al. | 312/21 |
| 1,421,564 | 7/1922 | Reche | 312/24 |
| 1,934,370 | 11/1933 | Mirabella | 312/21 |
| 2,607,651 | 8/1952 | Preuss | 312/30 |
| 2,663,607 | 12/1953 | Schaper | 312/208 |
| 2,738,248 | 3/1956 | Berker | 312/29 |
| 2,790,689 | 4/1957 | Hubbell | 312/21 |
| 2,909,401 | 10/1959 | Bjorgan | 312/30 |
| 3,468,589 | 9/1969 | Maynard | 312/29 |
| 3,726,237 | 4/1973 | Devey et al. | 108/92 |
| 4,005,918 | 2/1977 | Smith et al. | 312/27 |
| 4,108,512 | 8/1978 | White | 312/24 |
| 4,183,594 | 1/1980 | Mey et al. | 312/27 |

FOREIGN PATENT DOCUMENTS

| | | | |
|---|---|---|---|
| 916212 | 6/1954 | Fed. Rep. of Germany | 312/21 |
| 6807243 | 11/1968 | Fed. Rep. of Germany . | |
| 2804736 | 2/1978 | Fed. Rep. of Germany . | |
| 1328532 | 4/1920 | France . | |
| 53-40364 | 9/1976 | Japan . | |
| 282340 | 4/1950 | Switzerland . | |

*Primary Examiner*—Victor N. Sakran

*Attorney, Agent, or Firm*—William V. Ebs; Robert E. Smith; Edward L. Bell

[57] ABSTRACT

A sewing machine cabinet is provided with a cradle which may be latched in a horizontal position, a mounting platform for a sewing machine, linkage means upon which the platform is suspended from the cradle in a lowered working position, and a manually operable lever for operating the linkage means to move the platform between the lowered working position and a raised working position.

10 Claims, 5 Drawing Figures

TWO LEVEL SEWING MACHINE CABINET

DESCRIPTION

BACKGROUND OF THE INVENTION

1. Field of the Invention:

The invention relates to sewing machine cabinets. More particularly, the invention relates to sewing machine cabinets in which a sewing machine can be moved between a flat bed and free arm position, and wherein the machine may also be disposed in a stowed position.

2. Description of the Prior Art:

It is known to provide a sewing machine cabinet with a drop shelf and a mounting platform for a sewing machine which rests horizontally upon the shelf in a flat bed position of the machine, but which can be raised therefrom to dispose the machine in a free arm position. A cabinet of this kind is shown, for example, in U.S. Pat. No. Re., for "Work Cabinet for Sewing Machine" of Kent S. Roberts and Stanley D. Roberts reissued June 1, 1979. Such cabinets accomodate movement of a sewing machine into and out of a stowed position, flat bed position and free arm position, and should be arranged for efficient use of cabinet space. Further, mechanism should be provided which enables an operator with minimum effort to quickly move a machine into a desired position in the cabinet; and any control lever for use in applying the force necessary to move the machine, as between the flat bed and free arm position, should be unobstrusive and disposed so as not to be bothersome to the operator when seated at the cabinet. Heretofore, cabinets for sewing machines have generally been deficient in one or more of the foregoing respects, and it is a prime object of this invention to provide an improved sewing machine cabinet which is without these deficiencies.

SUMMARY OF THE INVENTION

In accordance with the invention, a sewing machine cabinet including side walls and an apertured top wall is provided below the top wall aperture with a cradle which is hingedly attached to a side wall of the cabinet for movement between a dropped position and a substantially horizontal position. A mounting platform for a sewing machine is connected by linkage means to the cradle. The cradle may be latched in its substantially horizontal position, and when so situated, the mounting platform may be moved by a manually operable lever between a lowered and raised work position to provide for flat bed and free arm sewing, respectively. In its lowered position the platform is suspended from the cradle by the linkage means against a stop, and in its raised position the platform is level with the top wall of the cabinet. In one form of the invention, the platform and a machine thereon are moved in an arcuate path in one direction during raising of the platform, and an insert is provided for use in a space left in the aperture at the sewing end of the machine in its raised position to provide a work surface adjacent a work surface on the machine bed. In another form of the invention the platform and machine are moved in an arcuate path in the opposite direction to cause the sewing end of the machine in its raised position to abut against the top wall of the cabinet at one end of the aperture, and the work surface on the machine and top wall of the cabinet to lie adjacent to each other without an insert.

DESCRIPTION OF THE INVENTION

Figure 1:
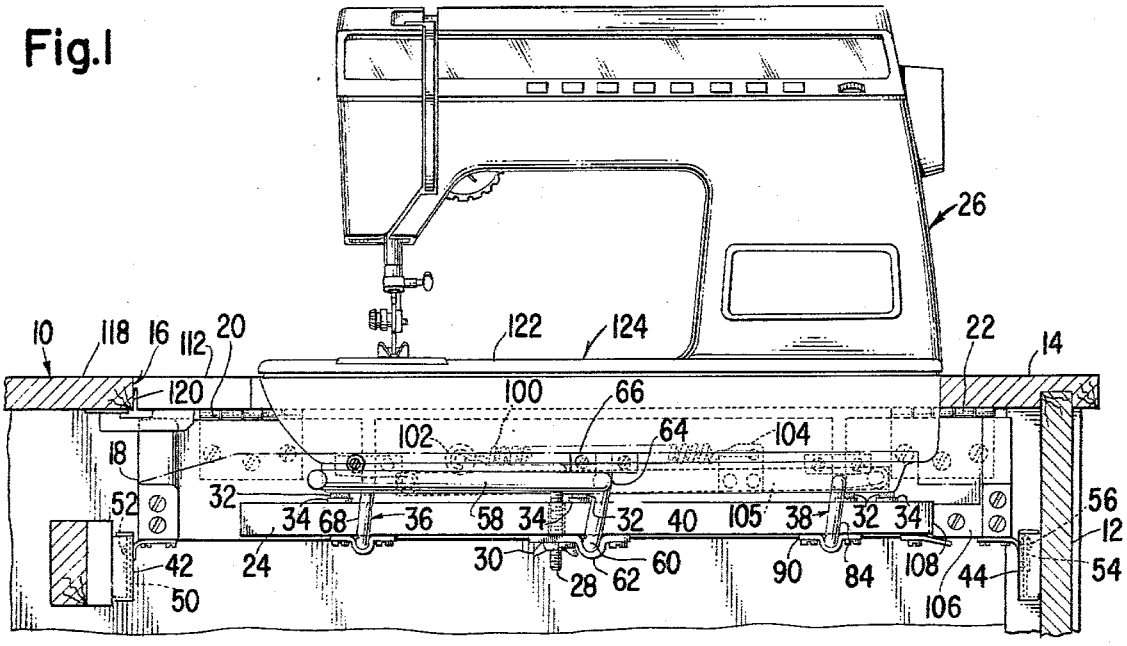
FIG. 1 is a front elevational view, partially in section, showing a sewing machine in a lowered position within a cabinet constructed according to the invention.

Referring to FIGS. 1 through 4 of the drawings, reference character 10 designates a sewing machine cabinet according to the invention, including side walls 12 and a top wall 14 with a rectangularly shaped aperture 16 therein. The cabinet is provided with a cradle 18 which is hingedly supported at 20 and 22 on a rear side wall for movement between a dropped position and a substantially horizontal position. The cabinet is further provided with a mounting platform 24 for a free arm sewing machine 26 of the type disclosed, for example, in U.S. Pat. No. Des. 241,076 of Donald M. Genaro and Cristian J. Felix, issued Aug. 17, 1976; and such a machine is shown secured to the platform with a hooked bolt 28 and wing nut 30 in a fixed position defined by the engagement of pads 32 on the machine in cups 34 affixed to the platform. The mounting platform is connected to the cradle by linkage means including a link 36, a link 38, and a crank 40. Latching means are provided for holding the cradle in its substantially horizontal position, and such latching means includes latching ears 42 and 44 which are affixed in the cabinet, a pivoted pawl 50 on the cradle biased by a spring 52 and engageable with ear 42, and a pivoted pawl 54 on the cradle biased by a spring 56 and engageable with ear 44.

Figure 2:
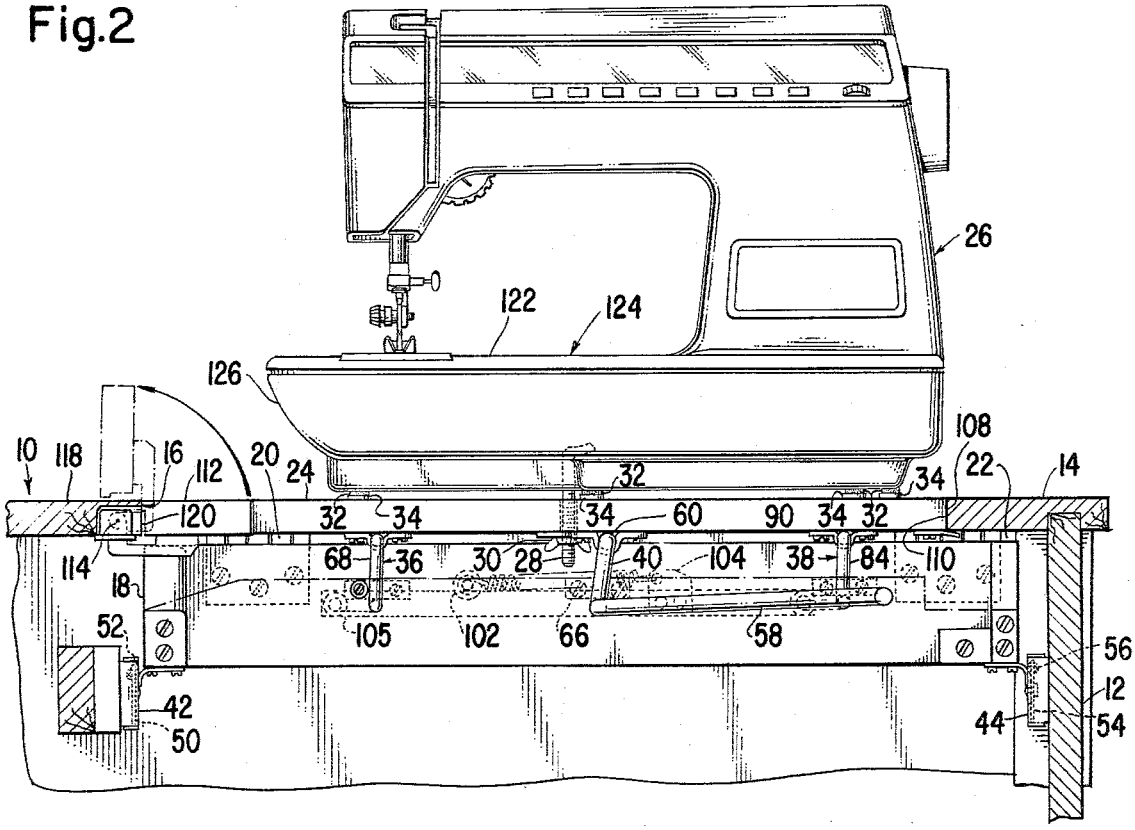
FIG. 2 is a view similar to FIG. 1 showing the machine in a raised position in the cabinet.
Figure 3:
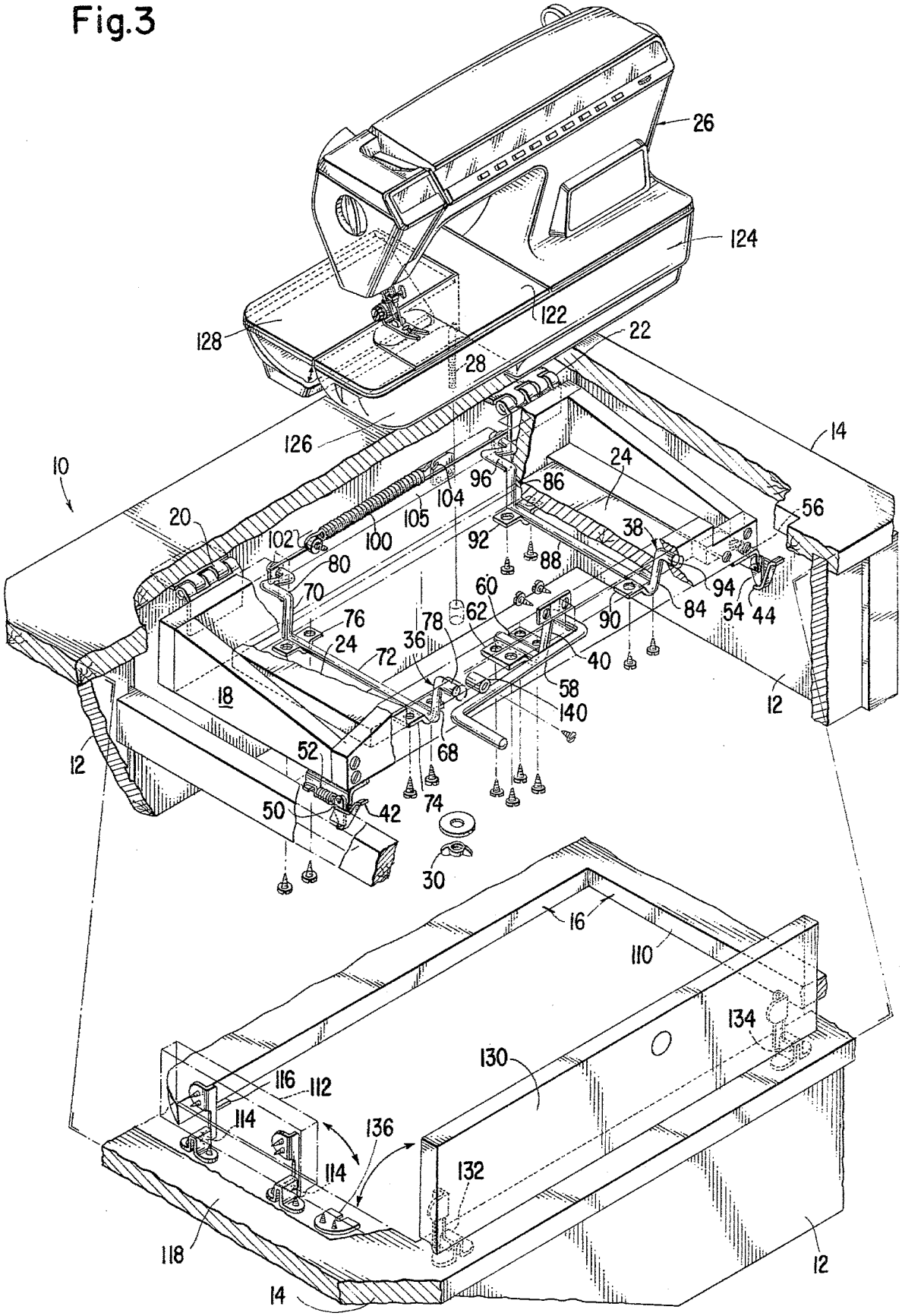
FIG. 3 is a perspective partially exploded view of the cabinet with portions broken away to show the operating mechanism therein.
Figure 4:
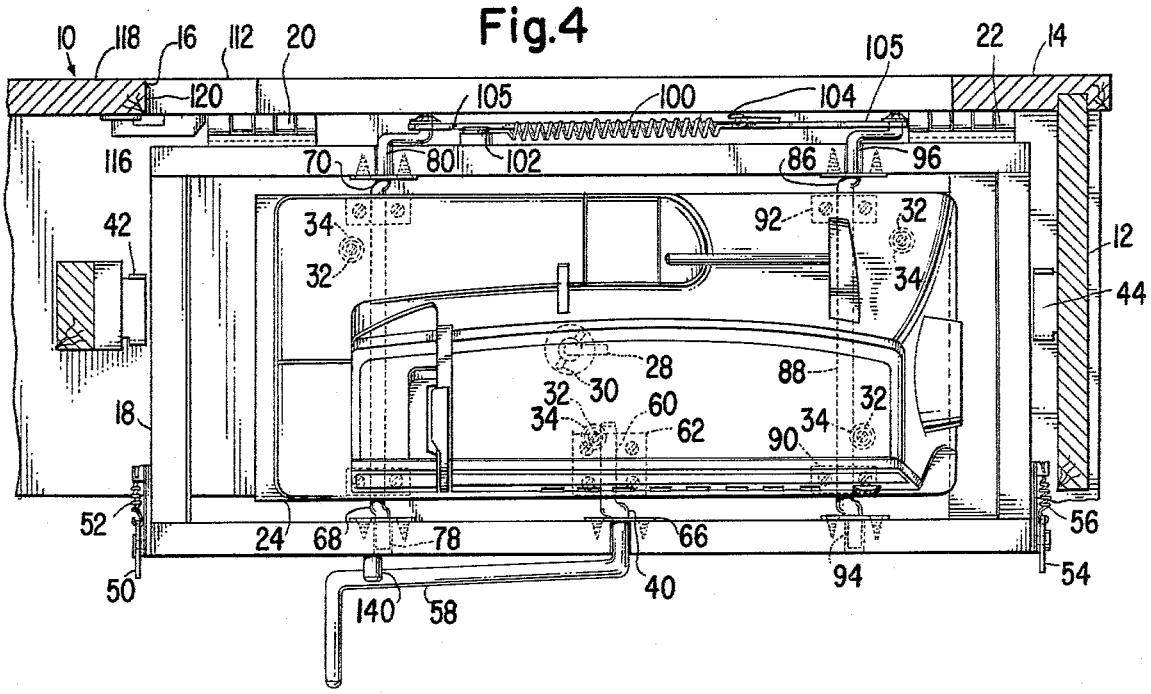
FIG. 4 is a front elevational view, partially in section, showing the machine in a stowed position in the cabinet.

In the latched position of the cradle 18, the mounting platform may be caused to assume a lowered work position wherein it is suspended from the cradle by the linkage means as shown in FIG. 1, and it may be caused to assume a raised working position as shown in FIG. 2. A manually operable lever 58 which is integral with the crank 40 is provided for use in moving the platform between its lowered and raised working positions. Lever 58 extends substantially horizontally to the left, as illustrated in FIG. 1, when the platform is in its lowered working position.

As shown, the crank is pivotally mounted at one end 60 in a bracket 62 which is affixed to the cradle, and is pivotally mounted at the opposite end 64 in a bracket 66 which is affixed to mounting platform 24. Link 36 includes arms 68 and 70 which are integral at one end with an interconnecting cross-piece 72 that is pivotally mounted in brackets 74 and 76 affixed to platform 24 and which are pivotally mounted at their opposite ends 78 and 80 in the cradle 18. Similarly, link 38 includes arms 84 and 86 which are integral at one end with an interconnecting cross-piece 88 that is pivotally mounted in brackets 90 and 92 affixed to the platform 24 and which are pivotally mounted at their opposite ends 94 and 96 in cradle 18. Crank 40, in response to the operation of lever 58, applies controlling raising and lowering forces to the platform 24, and the links 36 and 38 stabilize and guide the platform as it is moved. A tensioned spring 100 which is affixed at one end 102 in the cradle 18 and at the other end 104 to an elongated member 105 interconnecting the links 36 and 38, assists in the raising of the platform 24 and machine 26 thereon.

In the lowered working position of platform 24, movement thereof to the right as viewed in FIG. 1 is prevented by an abutment 106 on the cradle 18 extending from the front to the rear thereof and serving as a stop engageable with the righthand edge 108 of the platform. Movement of the manually operable lever in a clockwise direction causes the platform 24 to be moved by the crank 40 (as assisted by the spring 100) to the left away from abutment 106 and upwardly in an arcuate path to the raised position shown in FIG. 2 in which the righthand edge 108 of the platform is caused to engage the top wall 14 of the cabinet at the right end 110 of aperture 16.

A flap 112 is provided at the left end of aperture 16 as shown. Such flap is movable about a pivotal mounting at 114 in the top wall 14 of the cabinet and can be disposed in either a substantially horizontal position wherein it is supported on a stop 116, or in an upright out-of-the-way position. When the platform is in its lowered position, the flap should be disposed in its horizontal position to serve as an insert in the aperture 16 and extend the top surface 118 of wall 14 of the cabinet beyond the left end 120 of the aperture to a location at which the flap and sewing end of the machine are substantially contiguous. When the platform is to be raised, the flap 112 is temporarily disposed in its upright position to permit the machine to move freely through the aperture 16.

In the lowered position of the platform 24, the top surface 122 of the sewing machine bed 124 is substantially at the level of the top surface 118 of the cabinet 10 including flap 112, and fabric to be sewn can be supported on such surfaces of the cabinet and bed while sewing operations are performed. In the raised position of the platform, arm 126 of the bed 124 at the sewing end of the machine is above the level of top surface 118, and if the machine is then converted for free arm sewing, the sleeves of garments, socks and other like items can be conveniently supported around the arm while being sewn. A machine may be variously constructed to enable a conversion for free arm sewing, however, by way of example, machine 26 has been shown as including a surface portion 128 which is to be understood as normally occupying a position wherein it is part of the work supporting bed surface, but being pivotally connected to the bed structure as in the manner disclosed in U.S. Pat. No. 4,009,671 of Hilmer Wittler and Adolf Martin for "Convertible Bed For Sewing Machines", issued Mar. 1, 1977, so that it may be pivoted away from the arm 126 to a position enabling the said arm 126 to be used for free arm sewing.

A flap 130 is provided at the front end of aperture 16 where it is connected by hinges 132 and 134 to the cabinet structure for movement between a horizontal position where it is supported on a tab 136 affixed to top wall 14, and an upwardly extending vertical position where it is supported on the hinges. The flap 130 is normally disposed in the horizontal position where it extends the top surface of the cabinet in front of the machine, but is moved to the upwardly extending position to permit the platform 24 and machine 26 to be moved from a lowered position through the aperture 16 to a stowed position in the cabinet. Before the machine is stowed, manually operable lever 58 is flexed downwardly beyond a fixed abutment 140 on the cradle and caused to assume the position shown in FIG. 3 wherein the abutment serves as a keeper for the lever. The machine is stowed by then lifting it slightly to unlatch the cradle 18 at 42, 50 and 44, 54 for downward pivotal movement in the cabinet about the hinge connections at 20 and 22, after which the machine, platform and cradle are lowered as a unit to the position illustrated in FIG. 4. Abutment 106 on the cradle, and abutment 140 also on the cradle, prevent longitudinal movement of the machine and platform during movement of the machine into its stowed position and while in such position.

Figure 5:
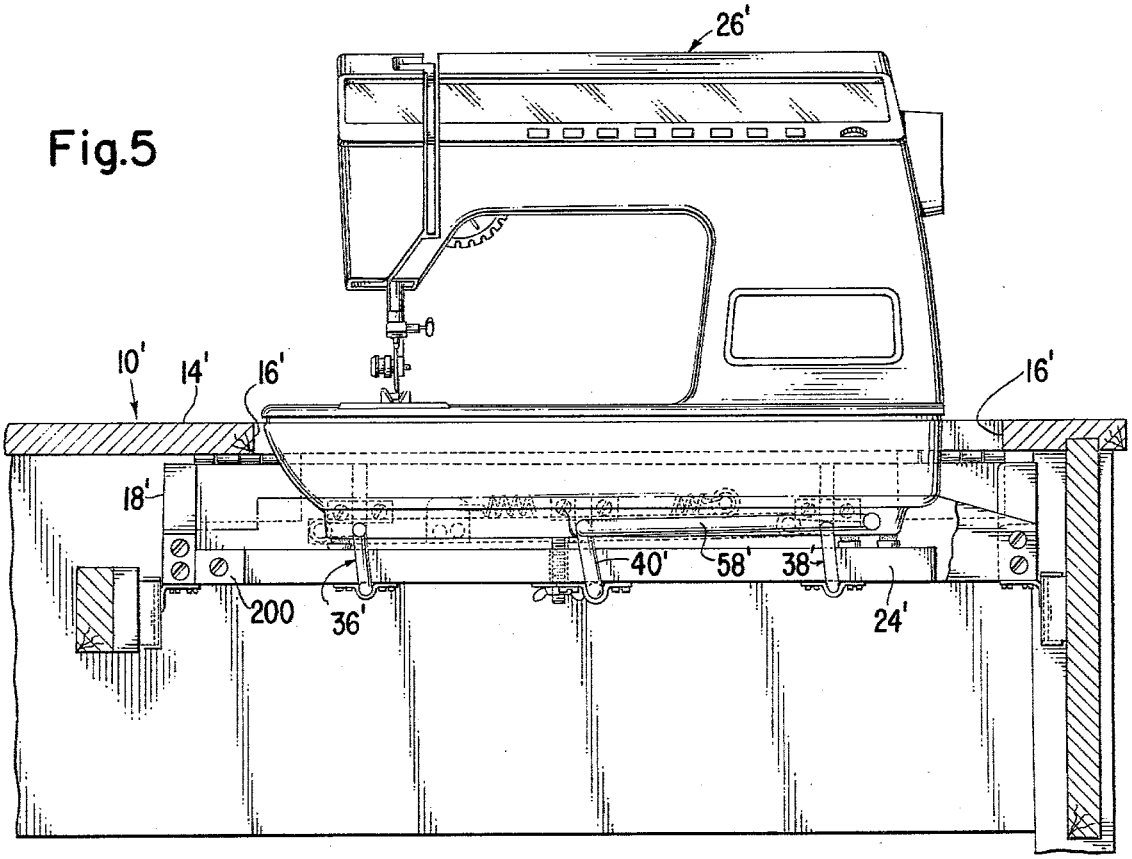
FIG. 5 is a front elevational view, partially in section, of a cabinet constructed according to a modified form of the invention.

In a modified form of the invention shown in FIG. 5, wherein parts which are similar to those shown in the other figures of the drawings are designated with like reference characters having a prime mark (') added thereto, a cabinet 10' is provided which is generally similar to the cabinet already described, but which is particularly adapted to avoid the need for a work supporting end flap in an aperture 16' provided in the top of the cabinet for a sewing machine 26'. The cabinet 10' is so adapted by having a mounting platform 24' suspended within the cabinet in a lowered work position from a latched cradle 18' on links 36' and 38', and a crank 40' in a position wherein the sewing end of the machine is caused to engage or at least substantially engage the top wall 14' of the cabinet at the lefthand end of the aperture 16'. The mounting platform 24' also preferably engages a stop 200 on the cradle in such lowered position and is movable therefrom to a raised working position by counterclockwise rotation of a manually operable lever 58' which in the lowered position of the platform extends substantially horizontally to the right as viewed from the front of the machine in FIG. 5. The aperture 16' is made sufficiently long to permit the machine to be moved freely therethrough in an arcuate path by the linkage means and extends in the lowered position of the platform beyond the righthand end of the machine. No flap is required to fill in the space between the righthand end of the machine and the table, since the additional surface area which a flap could provide isn't required at this end of the machine to support material during a sewing operation.

It is to be understood that the present disclosure relates to preferred embodiments of the invention which are for purposes of illustration only, and that various modifications may be made therein without departing from the spirit and scope of the invention as defined in the appended claims.

We claim:

1. A sewing machine cabinet including side walls and an apertured top wall providing a top work surface for the cabinet, a cradle spaced below said top wall under the aperture thereof and hingedly attached to a wall of the cabinet for movement between a dropped position and a substantially horizontal position, latch means for normally holding the cradle in the substantially horizontal position, a mounting platform for a sewing machine, links which are pivotally connected to the platform and to the cradle and upon which the platform may be moved either downwardly in the cradle to a lowered working position wherein the platform is suspended from the cradle on the links below their pivotal axes in the cradle, or upwardly therefrom to a raised position wherein the platform is supported on the links above their pivotal axes in the cradle, stopping means for preventing movement of the platform in one direction on the links from said lowered suspended position, and manually operable means including a lever for moving the platform in the opposite direction on the links to the raised position.

2. The combination of claim 1 wherein the stopping means is located on the cradle to engage the platform in its lowered position.

3. The combination of claim 2 wherein the stopping means is located to prevent the platform while in its lowered position from being moved toward the far end of the cradle relative to the sewing end of the machine.

4. The combination of claim 3 wherein the top wall of the cabinet is substantially contiguous at one end of said aperture with the sewing end of the machine in the raised position thereof.

5. The combination of claim 2 wherein the stopping means is located to prevent the platform while in its lowered position from being moved toward the near end of the cradle relative to the sewing end of the machine.

6. The combination of claim 5 wherein the top wall of the cabinet is spaced at one end of said aperture from the end of the bed of the machine in the raised position thereof, and said combination includes an insert disposable in such space.

7. The combination of claim 1 including a keeper on the cradle engageable by the lever for affixing the position of said lever on the cradle when the platform is in its lowered position.

8. The combination of claim 7 wherein the keeper is a member which projects from one side of the cradle and over which the lever may be forced to affix it in an extreme position.

9. The combination of claim 1 wherein the manual operable means includes a crank integral with the lever.

10. The combination of claim 9 wherein the crank is located between the links, and the links are located near opposite ends of the cradle and platform.

* * * * *